US005372269A

United States Patent [19]

Sutton et al.

[11] Patent Number: 5,372,269

[45] Date of Patent: Dec. 13, 1994

[54] MULTIPURPOSE CONTAINER AND DISPLAY SIGN

[75] Inventors: Kim C. Sutton, St. Charles; Maynard Johnson, Kirkwood, both of Mo.

[73] Assignee: Creative Thermal Vac Manufacturing, Inc., St. Peters, Mo.

[21] Appl. No.: 872,449

[22] Filed: Apr. 23, 1992

[51] Int. Cl.[5] ..... B63B 67/12

[52] U.S. Cl. ..... 220/62; 220/404; 220/4.09; 220/666; 220/690; 220/908; 229/89; 229/125.28

[58] Field of Search ..... 229/89, 40, 149, 4.5, 229/125.17, 125.28; 248/97, 99, 100; 220/62, 400, 403, 404, 4.04, 4.05, 4.09, 475, 908, 666, 676, 682, 690

[56] References Cited

U.S. PATENT DOCUMENTS

| | | | |
|---|---|---|---|
| 228,002 | 5/1880 | Swope | 229/89 |
| 668,705 | 2/1901 | Bakerville | 229/40 |
| 672,282 | 4/1901 | Munford | 220/62 |
| 836,555 | 11/1906 | Birnie | 220/475 |
| 979,261 | 12/1910 | Compton | 229/125.28 |
| 1,500,917 | 7/1924 | Bell | 220/4.09 |
| 2,143,436 | 1/1939 | Edgin et al. | 220/4.09 |
| 2,789,750 | 4/1957 | Krainer | 229/149 |
| 3,933,300 | 1/1976 | Dempster | 229/149 |
| 4,457,483 | 7/1984 | Gagne | 220/403 |
| 4,491,232 | 1/1985 | Hansen | 220/475 |
| 4,700,883 | 10/1987 | Vajtay et al. | 229/125.28 |
| 4,711,367 | 12/1987 | Albertson | 220/404 |
| 4,846,394 | 7/1989 | Swanson | 229/4.5 |
| 4,892,223 | 1/1990 | DeMent | 220/404 |
| 4,955,496 | 9/1990 | Nelson | 220/403 |
| 5,052,578 | 10/1991 | Goodwin | 229/125.17 |
| 5,056,679 | 10/1991 | Lonczak | 220/404 |
| 5,096,080 | 3/1992 | Penny | 220/4.09 |
| 5,196,988 | 3/1993 | Horn | 229/149 |

FOREIGN PATENT DOCUMENTS

| | | | |
|---|---|---|---|
| 659357 | 6/1929 | France | 220/4.09 |
| 3941310 | 6/1991 | Germany | 229/125.17 |

*Primary Examiner*—S. Castellano

*Attorney, Agent, or Firm*—Haverstock, Garrett & Roberts

[57] ABSTRACT

A multipurpose panel structure formed of a relatively thin resilient type material adaptable for use both as a container device and as a display sign, the panel structure comprising a relatively flat one-piece wall member having a cooperatively engageable interlocking arrangement associated therewith enabling the wall member to be formed into an open-ended closed wall structure capable of standing on end to form a container device, the cooperatively engageable interlocking arrangement being releasably detachable so as to enable the wall member to return to its normally flat condition for use as a display sign. The present wall member can be formed into a cylindrical shape, or it can be scored or otherwise weakened at various locations on its surface so as to form a multi-sided container structure. Any plurality of the present wall members may be connected together to form a multitude of container sizes and shapes. The container assemblies formed by the various embodiments of the panel structures disclosed herein are particularly adaptable for holding a wide variety of waste materials including recyclable materials.

8 Claims, 6 Drawing Sheets

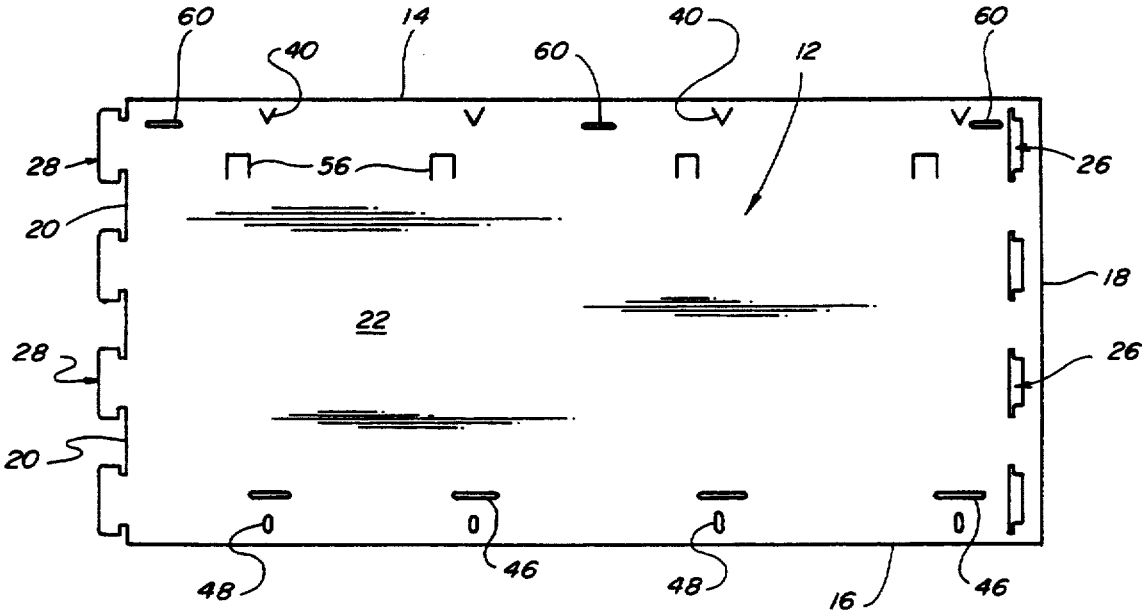
Fig. 2
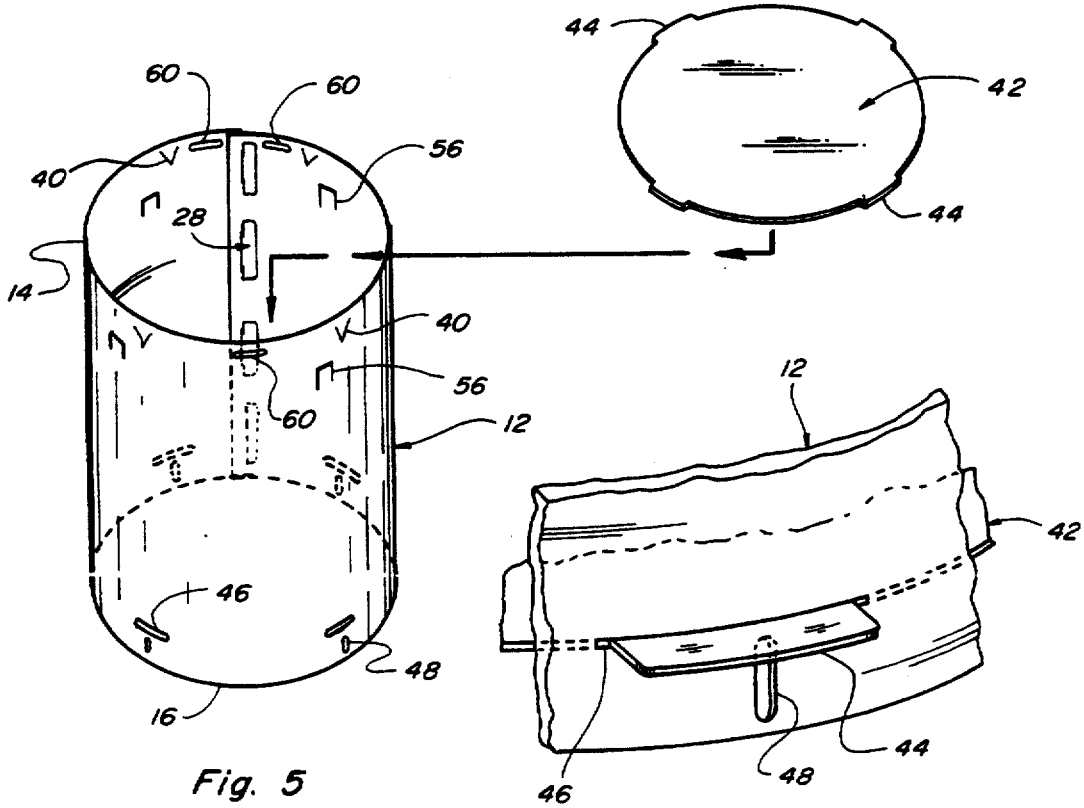
Fig. 5
Fig. 6

MULTIPURPOSE CONTAINER AND DISPLAY SIGN

The present invention relates generally to a container assembly for holding a wide variety of waste materials including recyclable materials such as recyclable aluminum cans, newspaper, cardboard and glass and/or plastic containers and, more particularly, to several embodiments of a multipurpose container assembly which can also be alternatively utilized as a display sign. In its preferred embodiment, the present container assembly is comprised primarily of a single flat sheet of a resilient type material which is shaped and connected together to form an open-ended closed wall panel structure, which panel structure can be formed into a variety of shapes such as a rectangular, square, cylindrical or other shape, and which panel structure can be imprinted, embossed or otherwise decorated with indicia such as a company logo, promotional material, or other data. When not used as a container assembly, the closed wall panel structure can be returned to its original flat condition and alternatively used in a wide variety of different applications as a display sign. It is also anticipated that any plurality of panel structures may be joined together to achieve any particular size container assembly. Optional floor and top cover means are also incorporated into the present device. The separate components comprising the present container assembly can be packaged, stored and furnished in substantially flat form and they can be easily assembled and disassembled without tools or other means. Although the present container assembly is primarily designed for use in a business or commercial environment, it can be utilized in any environment.

BACKGROUND OF THE INVENTION

In an office, store, merchandising or any other environment, many different types of waste containers are abundantly used for storing and collecting waste type materials including recyclable materials such as aluminum cans, glass and plastic containers, paper, cardboard and so forth. Many different types of waste containers have been constructed and used in the past in all types of environments and for all types of applications. Typically, all such known prior art container devices are of a totally rigid, non-collapsible construction and, importantly, none of the known devices are designed to be repeatedly disassembled for ease of portability and/or for alternative usage as sign means. Also, a totally rigid construction makes the known devices expensive to manufacture as well as bulky, awkward and difficult to transport from one location to another. There therefore exists a need for an inexpensive waste container assembly which can be easily and conveniently employed in a wide variety of environments, both indoors and outdoors, which container assembly can be stored and shipped in a compact, flat package and can be easily and readily assembled and disassembled by a single non-skilled person without tools and without external fasteners or other components. The present invention not only satisfies this need, but it also provides for alternative usage in the form of a sign as an inexpensive means for promoting and/or advertising one's goods, services, company name or any other message or data commonly communicated by signage.

SUMMARY OF THE INVENTION

The present invention teaches the construction and operation of a multipurpose waste container assembly wherein the container consists of several individual parts that can be stored, packaged and transported in substantially flat condition. An open-ended closed wall structure is formed from a single flat body panel that is made of a material that causes the panel to be somewhat resilient as well as somewhat biased towards its flat condition. Cooperatively engageable interlocking means are associated with each opposite end of the body panel, the interlocking means enabling the respective end portions of the body panel to be locked together at adjacent side edges to form various closed wall shapes such as a cylindrical, triangular, rectangular or square container structure. The design of the cooperatively engageable means is such that, when the body panel is in its closed wall form and such means are engaged, the resilience of the body panel creates sufficient pressure to retain such means cooperatively engaged. When the body panel is interlocked in its closed wall form, a plastic liner member is positioned therewithin for holding and collecting the particular waste or recyclable material discarded within the container. The plastic liner member is held in proper position within the closed wall body panel through the use of tab attachment means spacedly located adjacent the upper edge portion of the body panel along the exterior surface thereof. The liner attachment means are specifically designed to engage the plastic liner when the liner is overlapped over the upper rim portion of the body panel. This holds and maintains the plastic liner member in proper position within the container shaped body panel and prevents the same from falling or collapsing therewithin. When the liner member is full of waste or recyclable material, it can be easily disengaged from the liner attachment means and conveniently secured and disposed of. A new liner member can then be inserted within the container shaped body panel and re-attached to the liner attachment means for continuous use.

The present body panel also includes a plurality of openings or apertures positioned in spaced apart relationship adjacent the upper edge portion of the body panel for enabling the panel to be hung in its flat condition on a vertical or other supporting surface such as a wall, window and so forth when the body panel is not being used in its engaged closed wall form. In this regard, the body panel can be imprinted, embossed, engraved, etched or otherwise decorated with indicia and can be easily and conveniently used as a sign to promote the sale of goods and/or services in a commercial setting, to promote recycling, or to convey any particular message in an office or other environment. This is accomplished by positioning a corresponding number of nails, hooks, or other such attaching members at a predetermined location on the vertical or other supporting surface from which the body panel will be hung and thereafter engaging the openings or apertures in the body panel with such attachment means. This enables a user to imprint a company logo, advertising, promotional material, or any other message on the body panel and to display the same both when the present device is utilized as a waste container and, importantly, when it is used as direct signage in a storefront window or other suitable location. Since the body panel is made of a lightweight, preferably resilient or flexible, material as will be hereinafter explained, it can be easily assembled and disassembled for use both as display signage and as a container assembly. The present assembly affords a user several different options, particularly, in a commercial environment where one is promoting and merchandising goods and/or services.

The present container assembly may also include an optional floor member which is engageable with the body panel adjacent its lower end portion thereof, the floor member providing additional strength and stability to the body panel in its closed wall form as well as providing a support area for the waste or recyclable material positioned therewithin. When the optional floor member is incorporated into the present assembly, the resulting assembly may be utilized either with or without the plastic liner member as use of the optional floor member will obviate the need for a liner member if so desired. In certain applications, an optional top member including means for attaching the same to the body panel, handle means and means for fixedly securing the present container assembly to the ground in an outdoor environment may likewise be used with various embodiments of the present container assembly. It is also recognized that any number of such body panels may be joined together to form any particular size container assembly. Typical applications include use of the present container assembly as a waste or trash container, a container for holding and collecting any type of recyclable material, a compost bin, or any other type of storage container.

It is therefore a principal object of the present invention to teach the construction and operation of a multipurpose panel structure which can be used both as a container and as a display sign for promoting goods and/or services, or conveying any message of any kind.

Another object is to teach the construction and operation of a container assembly which can be packaged, stored and shipped in a substantially flat condition.

Another object is to teach the construction and operation of a container assembly which can be easily assembled without the use of tools or other fastener means for assembling the same.

Another object is to provide a container assembly having promotional indicia or other artwork imprinted, engraved, etched or otherwise formed thereon, which container assembly can also be utilized in a substantially flat condition as signage.

Another object is to provide a container assembly which can be easily broken-down for portability from one location to another.

Another object is to provide a container assembly having means associated therewith for securing the same at a particular location in an outdoor environment.

Another object is to provide a container assembly constructed of several components that, when assembled, provides a strong and rigid open-ended closed wall container having cooperatively engageable means capable of withstanding outward pressure, which cooperatively engageable means are self-locking when engaged.

Another object is to provide a container assembly which is constructed of relatively lightweight resilient materials and which is sturdy and able to withstand normal usage.

Another object is to provide a container assembly which is relatively simple and easy to assemble and disassemble.

Another object is to teach the construction and operation of a container assembly having means associated therewith for securely fastening a plastic liner member therewithin.

Another object is to teach the construction and operation of a container assembly formed by interconnecting a plurality of panel members to achieve any particular size and shape container.

These and other objects and advantages of the present invention will become apparent to those skilled in the art after considering the following detailed specification in conjunction with the accompanying drawings.

BRIEF DESCRIPTION OF THE DRAWINGS

FIG. 2 is a side elevational view of the body panel forming the container assembly of FIG. 1, the body panel being shown in its normal flat condition;

FIG. 5 is an exploded perspective view showing the optional floor member in the process of being positioned within the container assembly of FIG. 1;

FIG. 6 is a partial perspective view showing engagement of the optional floor member of FIG. 5 with the cylindrically formed body panel;

DETAILED DESCRIPTION OF THE INVENTION

Figure 1:
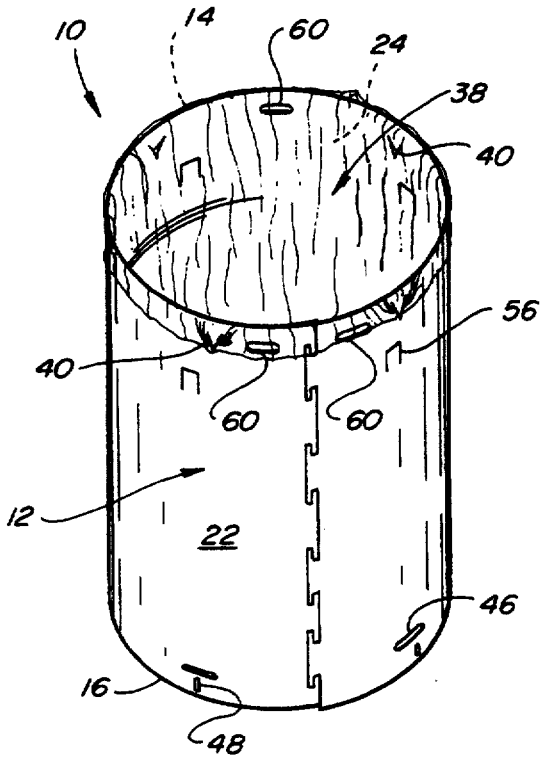
FIG. 1 is a perspective view of one embodiment of the present multipurpose container assembly constructed according to the teachings of the present invention.

Referring to the drawings more particularly by reference numbers wherein like numerals refer to like parts, number 10 in FIG. 1 identifies one embodiment of a multipurpose waste container assembly constructed according to the teachings of the present invention. The container assembly 10 includes a body panel or wall member 12 and a plastic liner member 38, the body panel 12 being formable into an open-ended closed wall structure capable of standing on end to form a cylindrical container as shown in FIGS. 1 and 5. The body panel 12 is generally rectangular in shape as shown in FIG. 2 and is generally comprised of a one-piece resilient type material such as a thin sheet of resilient plastic, metal, paperboard or other material including a thin wall or panel member made from recyclable materials. The member 12 includes spaced top and bottom edge portions 14 and 16, and spaced side edge portions 18 and 20 which define the perimeter of an outer surface 22 (FIG. 2) and an inner surface 24 (FIGS. 1 and 5). The member 12 is sufficiently flexible or resilient to enable it to be easily formed into a cylindrical shape as will be hereinafter explained.

Figure 3:
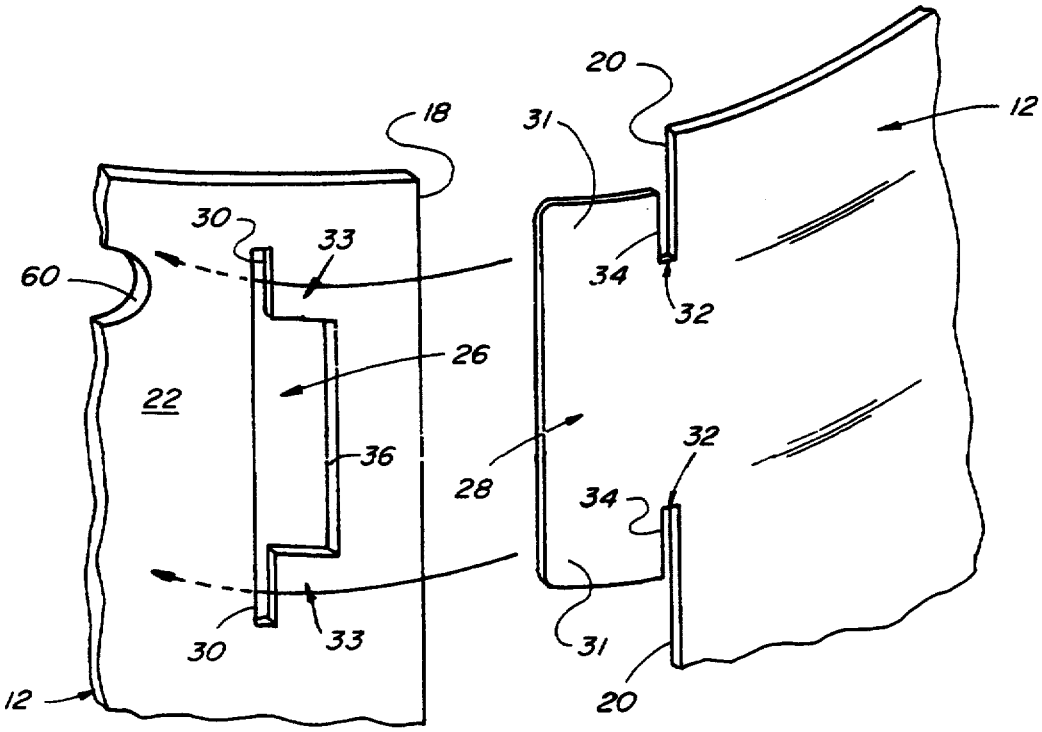
FIG. 3 is an enlarged partial perspective view of the body panel of FIGS. 1 and 2 illustrating how the cooperatively engageable interlocking means associated with the opposed side end portions thereof are arranged relative to each other prior to joinder.

Cooperatively engageable interlocking means are associated with each opposite side edge portion 18 and 20 of the body panel 12 for enabling such side edge portions to be interlocked together to form the body cylinder of FIG. 1. The cooperatively engageable means include a plurality of notches or openings 26 associated with side edge portion 18 and a plurality of sidewardly extending tabs or projections 28 associated with side edge portion 20 as best shown in FIGS. 2 and 3. The notches and tabs 26 and 28 respectively are preferably integrally formed with the body panel 12 and are correspondingly shaped to permit easy engagement with and disengagement from each other by any non-skilled person without the use of tools and without utilizing external fastening means or any other components. In this regard, each notch 26 includes elongated portions 30 which correspond in length to the overall length of the corresponding tab member 28 as best illustrated in FIG. 3. This means that each respective tab member 28 can be positioned through the elongated portions 30 of each respective notch 26 such that the entire tab member 28 is inserted therethrough. This construction ensures that each tab member 28 will be fully and completely inserted within its corresponding notch 26 as will be hereinafter further explained.

Each tab member 28 further includes a pair of opposed slots 32 located adjacent the respective side edge portions 20, the slots 32 defining a pair of bendable tab end portions 31 as best shown in FIG. 3. Once each respective tab member 28 is fully inserted within its corresponding notch 26, the bendable tab end portions 31 can be positioned underneath the panel portions 33 located adjacent the notch portions 30 as best shown in FIG. 3, and thereafter the tab members can be pulled back into a self-locking position with the inner edge portions 34 of each tab member 28 abutting the panel member 12 adjacent the outer edge portion 36 of each respective notch 26. In other words, each respective tab member 28 must be completely and totally inserted within the elongated portions 30 of each respective notch 26 such that the entire tab member 28 lies adjacent the inner surface 24 of the panel member 12 before such tab members are moved towards the edge portion 36 and into their self-locking position as previously explained. This means that when the two side edge portions 18 and 20 of the panel member 12 are pulled apart in opposite directions, the edge portions 34 of the tab members 28 will engage the panel member 12 adjacent the edge portions 36 of the corresponding notches 26 to prevent disengagement, both unintentionally and during use as a waste container.

It is also important to recognize that the tab members 28 must be inserted within the respective notches 26 as shown in FIG. 3 from the outer surface 22 towards the inner surface 24 of the member 12 so that the tab members 28 end up lying against the inner surface 24 in their coupled or joined condition. This is important not only from an aesthetic point of view, but also, more importantly, because such joinder maintains the cylindrical curvature of the body panel 12. In this regard, it is important that the body member 12 be made of a material that causes the panel member to be somewhat resilient and to be biased towards its flat condition. The design of the cooperatively engageable interlocking means 26 and 28 is such that, when the body panel 12 is interlocked in its cylindrical form, the resilience of the body panel 12 creates a pressure that helps to retain the joinder means 26 and 28 in their engaged and locked condition. In other words, the resiliency or bias of the sheet material will tend to move the opposed side edges 18 and 20 away from each other thereby holding and retaining the tab members 28 in their self-locking positions within the notches 26. The cooperatively engageable joinder means 26 and 28 cooperate with the resilient bias or force of the body panel 12 to maintain the curvature of the cylinder in a smooth continuous arc along the entire periphery thereof including across the interlocking joinder means 26 and 28. Although the tab members 28 may be interlocked with the corresponding notches 26 in reverse fashion such that the tab members 28 end up exposed adjacent the outer surface 22 of the panel member 12, such joinder does not always maintain the perfect cylindrical curvature of the body panel 12 when so joined and such arrangement is not aesthetically pleasing to the eye since the tab members 28 will extend outwardly and protrude away from the outer body panel surface 22.

Figure 4:
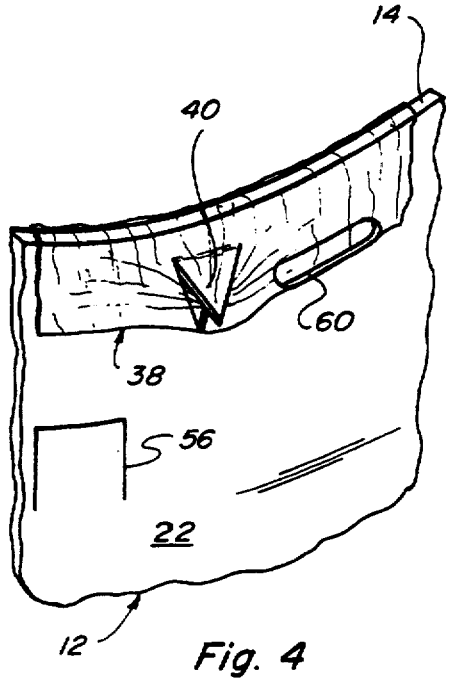
FIG. 4 is a partial perspective view of the body panel of FIGS. 1 and 2 showing the tab means for securely fastening the plastic liner member around the upper periphery of the body panel when the body panel is assembled in its cylindrical form.

Once the opposed side edges of the panel member 12 are interlocked as explained above, an open-ended closed wall cylindrical structure is achieved, which cylindrical structure is capable of standing on end to form a container. To this end, a plastic liner member 38 is positioned within the cylindrically formed body panel 12 for holding and collecting the particular waste or recyclable materials to be discarded therewithin. A plurality of triangularly shaped bendable tab means 40 are positioned in spaced apart relationship adjacent the upper edge portion 14 of the body panel 12 as best shown in FIGS. 2 and 4. The tab means 40 are specifically designed to engage the plastic liner 38 when the member 38 is overlapped over the upper edge portion 14 of the body panel 12 as illustrated in FIGS. 1 and 4. This is accomplished by pushing each respective tab member 40 outwardly as shown in FIG. 4 and thereafter tucking a portion of the liner member 38 under and around the tab member 40 so as to hold the same engaged therewith. The weight or force of the waste material collected within the liner member 38 will pull that portion of the liner member tucked under each respective tab member 40 upwardly thereagainst thereby holding and maintaining the liner member in proper position around and within the cylindrical body panel 12 and preventing the same from falling or otherwise collapsing therewithin as waste material is gathered. Also, the resiliency of the particular material utilized to form the body panel 12 will likewise bias each respective tab member 40 inwardly thereby tightly engaging and securing that portion of the liner member 38 tucked respectively therearound.

Once the liner member 38 is full of waste or recyclable material, it can be easily disengaged from the respective tab members 40 and thereafter conveniently secured for proper disposal thereof. A new liner member 38 can then be conveniently inserted and re-attached to the respective tab members 40 as previously explained. It is also anticipated that the triangularly shaped tab means 40 can be designed such that the liner member 38 will hang from such tab means adjacent the inner surface 24 of the body panel 12. In this embodiment, the tab means will be hinged from the bottom portion thereof and will be pushed inwardly for engagement with the liner member 38. Also, in this embodiment, the liner member 38 will not overlap the upper edge portion 14 of the member 12. It is also recognized that still other tab arrangements including different tab configurations can be utilized to hold and maintain the liner member 38 in proper position within the cylindrical body panel 12, whether such liner member is engaged adjacent the inner or outer surfaces 22 and 24 respectively of the panel member 12.

FIGS. 5 and 6 illustrate use of an optional floor member 42 which may be engaged with the body panel 12 adjacent its lower end portion as illustrated. The floor member 42 includes a plurality of circumferentially spaced outwardly extending ears or flanges 44 which cooperate with and extend through a plurality of correspondingly positioned elongated openings 46 located adjacent the bottom edge portion 16 of the panel member 12 as illustrated in FIGS. 2, 5 and 6. The location of the elongated openings 46 above the bottom edge portion 16 of the member 12 may be varied depending upon the particular application involved. Also, the floor member 42 should be made of a material of sufficient strength and rigidity to support the particular type of waste or recyclable material to be collected within the container 10. Use of the optional floor member 42 adds additional strength and stability to the body panel 12 in its cylindrical form and it obviates the need for using a liner member such as the liner member 38 for holding and collecting materials therewithin if so desired.

Figure 7:
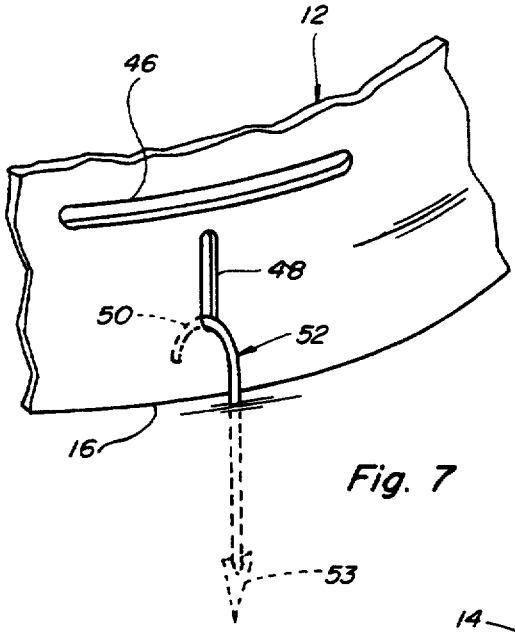
FIG. 7 is a partial perspective view of FIGS. 1 or 5 illustrating one method of fixedly securing the present container assembly to the ground in an outdoor environment.

Since the present container assembly is constructed totally from substantially lightweight materials, its use outdoors presents problems in that it can be easily toppled over by wind or other means. FIG. 7 therefore illustrates one method for fixedly securing the present container assembly in an outdoor environment. To this end, a plurality of elongated slots or openings 48 are positioned in spaced apart relationship adjacent the bottom edge portion 16 of the panel member 12 as best shown in FIGS. 2 and 7. The slots or openings 48 are specifically designed to receive one end portion of a stake or peg member such as the end portion 50 of the member 52 as illustrated in FIG. 7. Once the upper end portion 50 of the stake member 52 is inserted within any one of the respective slots 48, its opposite end portion 53 can be driven into the ground such that the end portion 50 bears against the bottom edge portion of the slot 48. Any number of stake members 52 may be utilized around the lower periphery of the panel member 12 to achieve the desired stability. This arrangement fixedly secures the present unit to the ground and prevents the same from being toppled by the wind or any other outdoor activity. This makes the present device ideally suited for use in an outdoor environment such as at picnics, when camping, and so forth.

It is important to remember that the elongated slots 48 must be so positioned and located adjacent the bottom edge portion 16 of the panel member 12 such that insertion of a stake or peg member therewithin will not interfere with or otherwise hinder use of the optional floor member 42. For this reason, it is preferred that the slots 48 be located below the plane of the floor member 42 if such optional floor member is incorporated into the present device. Although the slots 48 are shown in a location beneath the slots 46 in the accompanying drawings, it is recognized that both the shape and location of the slots 48 may be varied without departing from the spirit and scope of the present invention. It is also recognized that any plurality of panel members 12 may be cooperatively engaged with each other to increase the overall size of the cylindrical container 10. This enables a user to form any particular size container 10 depending upon the user's particular needs and the applications involved. In this event, it is recognized that the overall size of the floor member 42 will be made compatible with the resulting size of the cylindrical container formed by the plurality of panel members 12.

Figure 8:
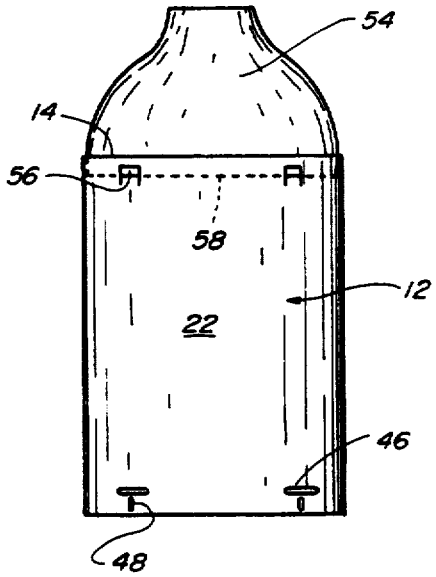
FIG. 8 is a side elevational view showing engagement of an optional top member with the container assembly of FIGS. 1 or 5.
Figure 9:
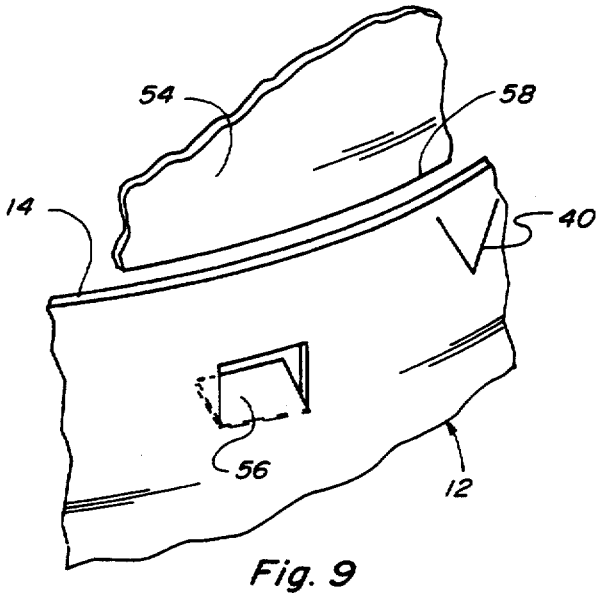
FIG. 9 is a partially exploded perspective view showing the lower peripheral edge portion of the optional top member of FIG. 8 in the process of being engaged with additional tab means associated with the upper portion of the body panel.

In certain environments and applications, particularly in a commercial or merchandising setting, an optional top member such as the top member 54 illustrated in FIGS. 8 and 9 may be utilized in conjunction with the present container assembly 10. In the particular embodiment illustrated in FIG. 8, the top member 54 is fashioned to represent the upper neck portion of a beverage bottle, which representation would be particularly applicable if the container assembly was utilized for collecting recyclable glass beverage bottles as well as beverage aluminum cans. The top member 54 is preferably of a one-piece integral construction having its lower end portion cylindrically shaped so as to be compatible with the upper edge portion 14 of the body panel 12 when the panel 12 is in its cylindrical form. This means that the outer diameter of the lower portion of the top member 54 is equal to or slightly less than the inner diameter of the container assembly 10 such that the lower edge portion 58 of the top member 54 will slide inside the upper edge portion 14 of the container assembly 10 as shown in FIG. 8. Engagement is accomplished through the use of bendable tab members such as the tab members 56 illustrated in FIGS. 8 and 9. As illustrated in FIG. 9, the tab members 56 are pushed inwardly as shown such that the lower edge portion 58 of the top member 54 will engage and rest upon the plurality of tab members 56. In this regard, it is preferred that the tab members 56 be located below the tab members 40 as illustrated in the accompanying drawings such that use of the optional top member 54 will not in any way interfere with attachment of the liner member 38 to the tab members 40. Like the body panel 12, the top member 54 is preferably made of a lightweight resilient or flexible material similar to the material used for body panel 12. The amount of overlap between the members 54 and 12 as illustrated in FIG. 8 depends upon the weight and configuration of the top member 54 and should be such that the member 54 rests in a stable position on top of the container assembly 10. Obviously, the greater the amount of overlap between the members 12 and 54, the greater the stability between such members. It is also recognized that other shapes and configurations of the top member 54 as well as the tab members 56 may be utilized.

It is also anticipated that the top member 54 may be designed to telescope to the outside of the container assembly 10 in total constrast to the inside telescoping arrangement illustrated in FIGS. 8 and 9. In this event, the bendable tab members 56 will have to be pushed outwardly in order to accomplish engagement of the same with the lower edge portion 58 of the top member 54. In addition, it is also recognized that the top member 54 may likewise be formed from a flat sheet of resilient type material having cooperatively engageable joinder means similar to joinder means 26 and 28 for engaging and maintaining the particular shape of the member 54. In this regard, the flat sheet forming the member 54 may be scored or otherwise weakened in certain areas in order to achieve the particular three-dimensional shape so desired including the upper bottle neck shape illustrated in FIG. 8. Here again, it is recognized that the lower edge portion 58 of the top member 54 will be sized so as to be compatible with the resulting upper edge portion of the container formed, either telescoping inside or outside of the container assembly 10, if a plurality of panel members 12 are utilized.

Figure 17:
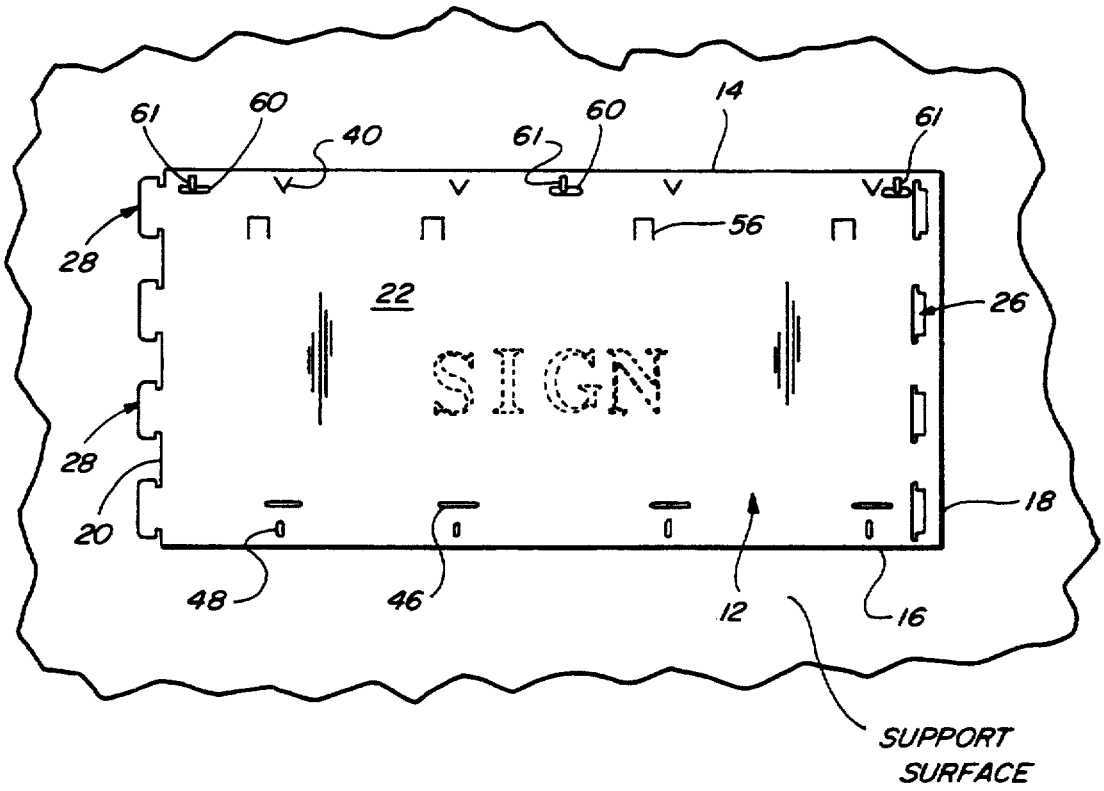
FIG. 17 is a side elevational view of the body panel of FIG. 2 illustrating one method of removably hanging the present body panel in its flat condition on a supporting surface for use as a display sign.

The body panel member 12 also includes a plurality of openings or apertures 60 positioned in spaced apart relationship adjacent its upper edge portion 14 as best illustrated in FIGS. 2 and 4. The openings 60 enable the panel member 12 to be removably hung in its flat condition on a wall, window, door or other equivalent support surface as best illustrated in FIG. 17 when it is not being used as a container in its engaged cylindrical form. This is accomplished by positioning any plurality of nails, hooks or other attaching means 61 at a predetermined location on the vertical or other supporting surface to which or from which the panel member 12 will be hung and thereafter engaging the openings 60 with such attachment means. It is also recognized that wire or twine means can also be looped around, laced through, or otherwise attached to the openings 60 so as to form a suspension means similar to that utilized for hanging pictures, paintings and other wall hangings, the suspension means being thereafter engageable with the pre-positioned attaching members for hanging the panel member 12. It is further anticipated and contemplated that a wide variety of other hanging arrangements as well as means for accomplishing the same in cooperation with the openings 60 may be utilized in association with the body panel 12. Although the openings 60 are illustrated as being elongated in shape for reasons which will be hereinafter explained, it is also recognized that other shapes and sizes of the openings 60 may likewise be utilized.

Importantly, the body panel 12 can be imprinted, embossed, etched, engraved or otherwise decorated with indicia on its outer surface 22 so as to convey a particular message, or to advertise and promote the sale of particular goods and/or services and, when hung in its flat condition as hereinbefore explained, it makes for an attractive display sign which can be used in a wide variety of different environments and applications. Use as a display sign enables a user to imprint a company logo, advertising, promotional material, or any other message on the outer surface 22 of the body panel 12 and to display this indicia both when the body panel 12 is utilized in its cylindrical form as a container assembly and, importantly, in its normal flat condition as direct signage in a business or other environment. This is particularly useful in a commercial environment where one is promoting and merchandising goods and/or services. It is also anticipated that indicia may likewise be imprinted or otherwise placed on the inner surface 24 of the body panel 12 thereby affording a user the capability of displaying two different sign messages. This further increases the usefulness and versatility of the present invention.

Figure 10:
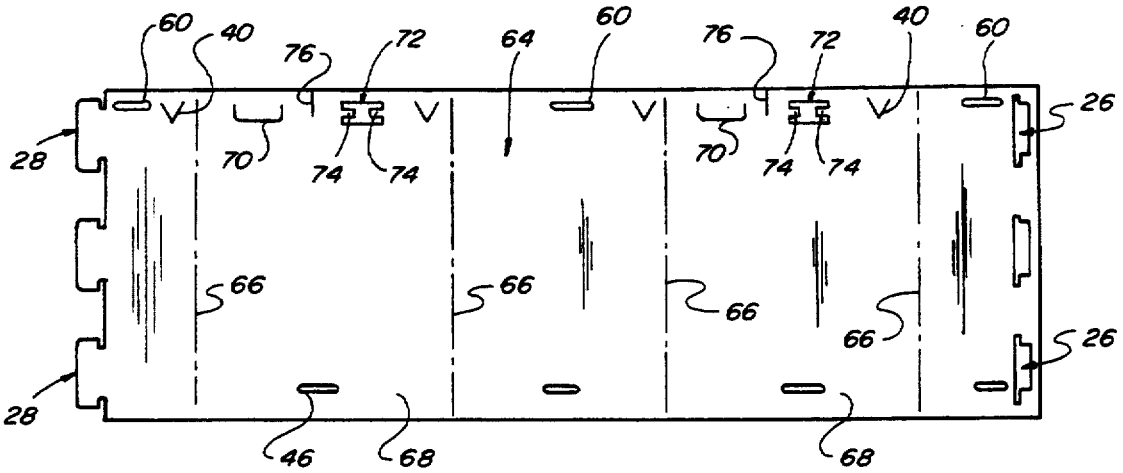
FIG. 10 is a side elevational view of another embodiment of the present body panel constructed according to the teachings of the present invention, the body panel being shown in its normal flat condition.
Figure 11:
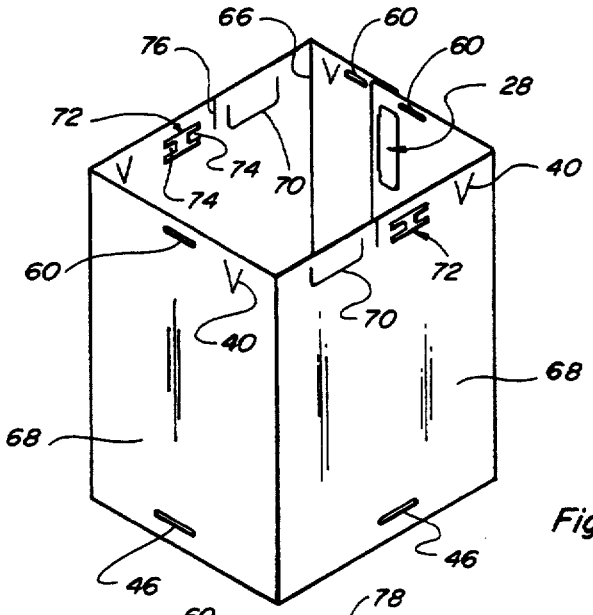
FIG. 11 is a perspective view of the container assembly formed by using the body panel illustrated in FIG. 10.

FIGS. 10 and 11 disclose another embodiment 62 of a container assembly which is formed from the one-piece resilient panel member 64. The panel member 64 is similar in construction and operation to the panel member 12 illustrated in FIG. 2 and, like the panel member 12, includes cooperatively engageable interlocking means 26 and 28, tab means 40, slot means 46, and a plurality of openings 60, all of which constructional features operate identical to those illustrated and described with respect to panel member 12. The body panel 64 differs from the body panel 12 in that it further includes a plurality of scored lines or weakening means 66 positioned as illustrated in FIG. 10, the weakening means 66 segregating the panel member 64 into a plurality of panel sections 68. Each panel section 68 is foldable or bendable about the respective weakening means 66 so as to allow the body panel 64 to be arranged and formed into a rectangular or square configuration as illustrated in FIG. 11. It is recognized that any number of panel sections 68 may be incorporated into any particular body panel 64 so as to achieve still other open-ended closed wall configurations such as a triangularly shaped container assembly as well as any other multi-sided shaped arrangement. Like the panel member 12, the body panel 64 is sufficiently flexible or resilient to enable it to be easily formed into a multi-sided configuration such as the rectangular or square configuration illustrated in FIG. 11.

The panel member 64 also includes handle means in the form of a plurality of bendable tab portions 70 which are positioned in spaced apart relationship on various panel sections 68 adjacent the upper edge thereof as illustrated in FIGS. 10 and 11. The handle tab portions 70 can be pushed or rotated inwardly forming a suitable gripping surface for lifting the container assembly 62.

The panel member 64 further includes a pair of opposed cut-outs 72 likewise positioned in spaced apart relationship adjacent the upper edge portion of the panel member 64. Each cut-out 72 is I-shaped in form and includes a pair of inwardly extending opposed bendable tab portions 74 which are specifically designed and shaped so as to be insertably positioned into the opposed end portions of a spool of string or twine. When so positioned in engagement with the tab portions 74, the spool of string or twine is rotatable therearound to facilitate easy winding and unwinding of the string or twine. In this regard, the overall height of the I-shaped cut-outs 72 should be such as to allow a normal size spool of string or twine to be received for free rotation therewithin.

The string holder means or cut-outs 72 are particularly useful when the container assembly 62 is utilized for holding and collecting recyclable newspaper or other paper products. When used in this capacity, a spool of string or twine can be engaged with the tab portions 74 associated with one of both of the opposed string holder means 72 and the string or twine can be pre-positioned down one panel portion 68, across the open bottom portion of the container assembly 62, and up the opposite panel portion 68 preparatory to tying off a stack of newspapers or other paper products once such recyclable paper has been collected within the container assembly 62. A slit 76 is located adjacent each string holder means 72 for engaging and holding the free end of the string or twine which has been pre-positioned within the container 62 as previously described. Once the container assembly 62 has been filled with recyclable paper products, a user can easily and conveniently complete the tying of the string or twine around the stack of collected paper goods. Thereafter, a user can cut the string or twine from the spool engaged with one or both of the string holder means 72 and then lift or pull the container assembly 62 via handle means 70 upwardly over the paper goods tied therewithin so as to expose the same for easy handling and removal thereof. It is also anticipated that the string holder means 72 may likewise be pre-positioned on one or both of the remaining panel sections 68 illustrated in FIG. 11 so that the paper goods collected within the container 62 may be tied in a cross-pattern for easier handling and maneuverability.

Optional floor means similar to the floor member 42 may likewise be utilized in conjunction with the container assembly 62, the only difference being that the floor member 42 will be shaped and dimensioned so as to be compatible with the size and shape of the resulting container configuration formed by panel member 64 such as the square or rectangular shape illustrated in FIG. 11. In all other respects, the floor member utilized in conjunction with the container assembly 62 will be identical to the floor member 42 illustrated in FIGS. 5 and 6, namely, similar flange portions 44 will cooperate with and extend through correspondingly positioned elongated openings 46 as previously explained. It is also anticipated that slot means similar to the slots 48 may also be utilized in conjunction with panel member 64 if the container assembly 62 is to be utilized in an outdoor environment. Similarly, the liner member 38 as well as an appropriately shaped top member similar to the top member 54 including means similar to tab means 56 for attaching the same to panel member 64 may likewise be utilized in conjunction with embodiment 62, if so desired. Like panel member 12, it is also anticipated that any number of panel members 64 may be cooperatively engaged together to form any particular multi-sided size and shape container assembly.

Figure 12:
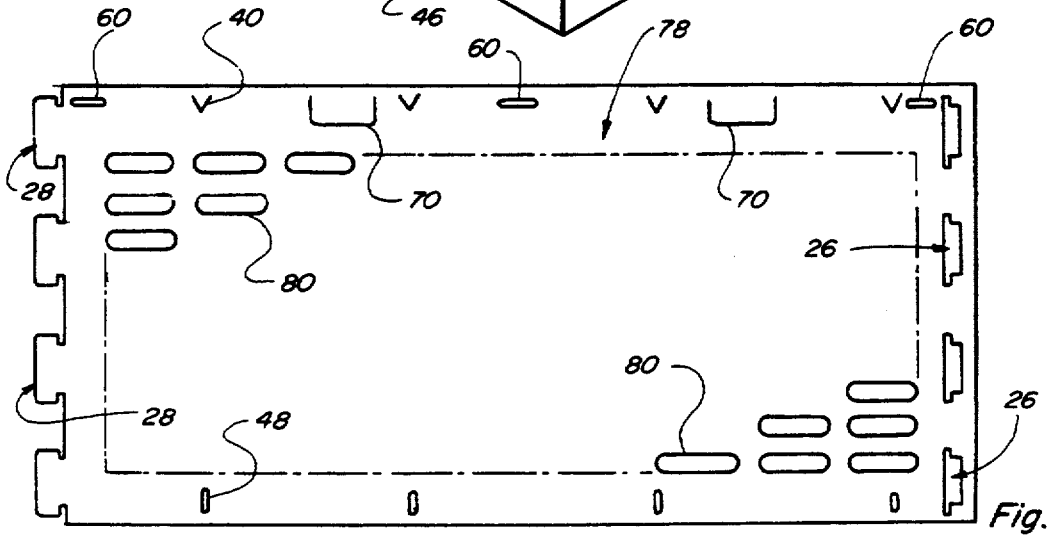
FIG. 12 is a side elevational view of still another embodiment of the present body panel shown in its normally flat condition.

FIG. 12 illustrates still another embodiment 78 of the present body panel, the panel member 78 again being substantially similar to panel members 12 and 64 in that it likewise includes cooperatively engageable interlocking means 26 and 28, tab means 40, apertures 48 and 60, and handle means 70. Panel member 78 differs from panel members 12 and 64 in that it further includes a plurality of openings 80 which act as ventilation means for allowing air to circulate throughout the closed wall structure formed by one or more panel members 78. The apertures 80 may be sized and shaped in any convenient form and may be positioned in any pattern, either wholly or partially, across the planar surface of the member 78. The panel member 78 is specifically designed for use in forming an open-ended closed wall structure which can be utilized as a compost bin in an outdoor environment. The openings 80 allow air to circulate through the decaying organic substances collected within the closed wall structure formed by panel member 78 thereby further promoting decomposition of the same. The panel member 78 may also likewise include a plurality of score lines or weakening means similar to the weakening means 66 illustrated in FIG. 10 such that the panel member 78 may be formed into a multi-sided configuration as compared to a cylindrical configuration. It is also recognized that any of the constructional features disclosed and described with respect to panel members 12 and 64 may likewise be incorporated into panel member 78 in any combination thereof based upon the particular use and application of the resulting container assembly. Still further, like the panel members 12 and 64, any number of the panel members 78 may likewise be cooperatively engaged to form any particular size and shape container. Importantly, all of the panel members 12, 64 and 78 can be embossed or otherwise imprinted with indicia for alternative usage as a display sign.

Figure 14:
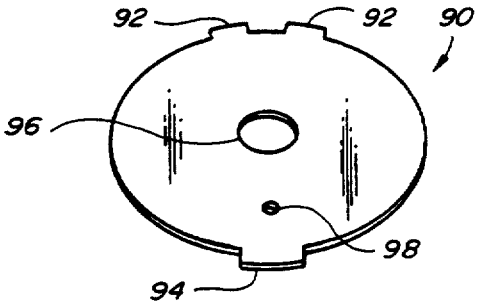
FIGS. 13 and 14 are perspective views of other embodiments of an optional top member constructed according to the teachings of the present invention.
Figure 13:
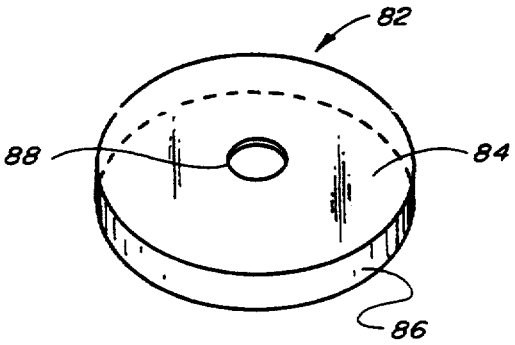

FIGS. 13 and 14 disclose other embodiments of an optional top member which may likewise be utilized with the present container assemblies. More particularly, FIG. 13 illustrates an optional top member 82 which is specifically designed for use with one of the present cylindrical container assemblies such as the assembly illustrated in FIGS. 1 and 5. The top member 82 is substantially cylindrical in shape and includes a top wall portion 84 and an annular sidewall portion 86 extending downwardly therefrom. The top wall portion 84 includes an opening 88 of sufficient size to allow recyclable material such as recyclable aluminum cans or other waste or trash material to be received therethrough. The annular sidewall portion 86 is shaped and dimensioned so as to be compatable with the particular cylindrical shape formed by the present panel members and is specifically designed to telescopingly engage the tab members 56 as previously described with respect to the top member 54 illustrated in FIGS. 8 and 9. When constructed to telescope to the outside of the particular container assembly to which it is being attached, such as the assembly 10 illustrated in FIGS. 1 and 5, the annular sidewall portion 86 need not engage the plurality of tab members 56 as, in such constructional arrangement, the top wall portion 84 will rest upon and be supported by the upper edge portion of the container assembly. Nevertheless, even in such an arrangement, engagement of the annular sidewall portion 86 with the plurality of tab members 56 will provide additional stability to the top member and it will prevent the top member 82 from being inadvertantly removed. Regardless of how the top member 82 telescopes onto the container assembly, the tab members 56 may be pushed inwardly or outwardly to engage the annular sidewall portion 86 to hold and maintain the same in proper position thereon. When used to collect recyclable aluminum beverage cans, both the optional top member 82 and the container assembly 10 may be fashioned or stylized to represent a conventional beverage aluminum can.

FIG. 14 illustrates another optional top member 90 which may be engaged with the container assembly formed by the present body panels adjacent their respective upper end portions. Unlike the top members 54 and 82, the top member 90 is substantially planar in shape and includes a plurality of circumferentially spaced outwardly extending ears or flanges 92 and 94 as illustrated in FIG. 14, the flanges 92 and 94 being specifically shaped and dimensioned so as to cooperate with and extend through the openings 60 as best illustrated in FIG. 5. The flange portions 92 are specifically spaced and dimensioned so as to be insertably positioned within the pair of elongated openings 60 located adjacent the top edge portion of the panel member 12 on either side of the joinder means 26 and 28 whereas flange portion 94 is specifically shaped and positioned so as to engage the opening 60 located in opposed relationship to the joinder means 26 and 28 as best illustrated in FIG. 5. The member 90 may also include an opening 96 as illustrated in FIG. 14 through which recyclable material or other waste may be inserted. Also, importantly, with this particular arrangement, the top member 90 will also function as a hinged lid-type member which can be repeatedly opened and closed to provide access to the inside of the container assembly. In this regard, the flange portion 94 may be disengaged from its corresponding opening 60 and the entire top member 90 may be rotated or pivoted upwardly with the flange members 92 still engaged with their corresponding openings 60, the flange portions 92 serving as hinge means about which the member 90 is pivoted or rotated. To accomplish this task, the flange portions 92 should be made of a resilient or flexible type material able to withstand repeated bending motion. This opening and closing feature of the top member 90 enables any one of the present container assemblies to be utilized as an ice chest or cooler for holding a wide variety of chilled products therewithin, the top member 90 providing a convenient and easy closure arrangement for such application. To facilitate such opening and closing, the member 90 may likewise include a finger opening 98 which serves as a convenient means for grasping and moving the member 90 between its open and closed positions. Although the optional top members 82 and 90 are illustrated as being adaptable for use with a cylindrical container configuration, it is recognized that the respective members 82 and 90 may be shaped and dimensioned so as to be compatable with the size and shape of the resulting container configuration formed by any of the panel members disclosed herein such as the square or rectangular shape illustrated in FIG. 11.

Figure 15:
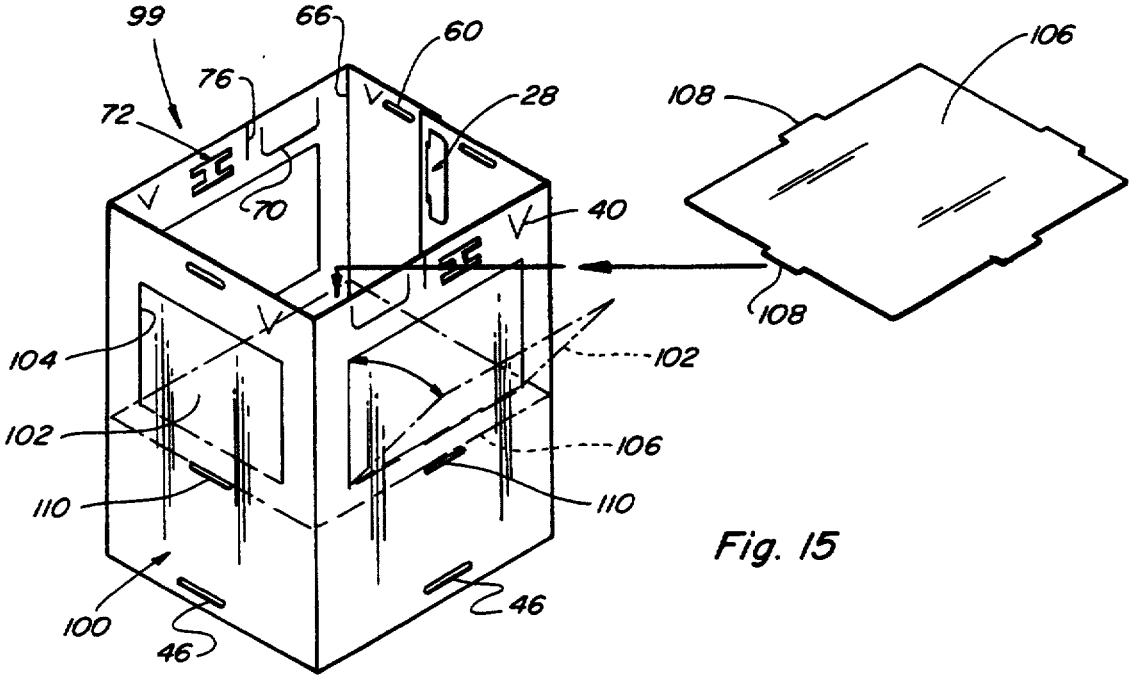
FIGS. 15 and 16 are perspective views of still further embodiments of the present body panel.
Figure 16:
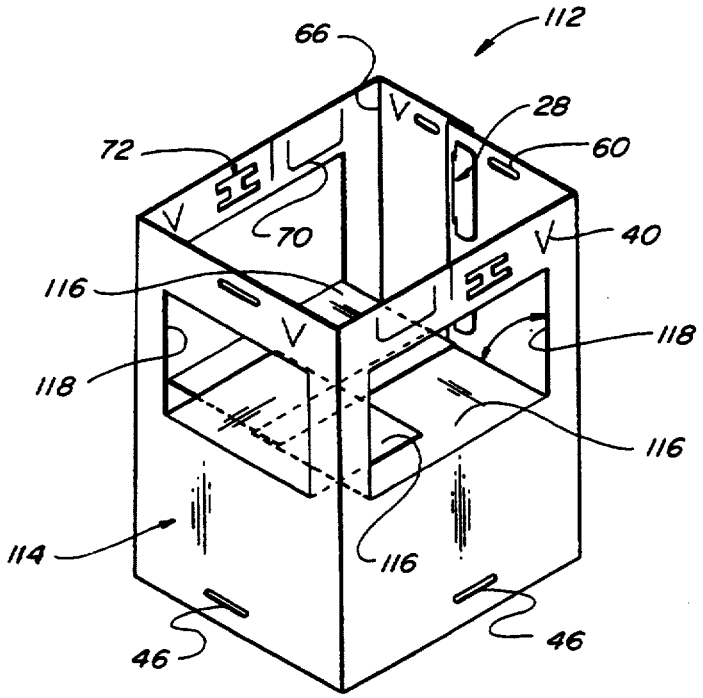

FIGS. 15 and 16 illustrate still further embodiments 99 and 112 of the present container assembly, which closed wall assemblies are formed by resilient panel members 100 and 114. The panel members 100 and 114 are again substantially similar to panel members 12 and 64 in that they likewise include cooperatively engageable interlocking means 26 and 28, tab means 40, apperatures 46 and 60, handle means 70, and string holder means 72. Panel member 100 (FIG. 15) differs from panel members 12 and 64 in that it further includes a removable Panel section 102 located on three respective sides thereof as illustrated in FIG. 15, removal of the panels 102 enabling the closed wall structure formed by one or more panel members 100 to function as a product merchandising display unit as will be hereinafter explained. The periphery of each of the panel sections 102 is scored or otherwise weakened such that each panel section 102 may be easily removed from panel member 100. Removal of the panel sections 102 form respective openings 104 on all three sides of the container assembly formed by panel member 100 as illustrated, the openings 104 providing both visibility and access to the inside portion of the container assembly. The one side of panel member 100 incorporating joinder means 26 and 28 does not include a panel section 102 for obvious reasons. To facilitate use as a product merchandising display unit, a shelf member 106 is provided with this particular embodiment, the member 106 being engageable with the panel member 100 at a location slightly below the bottom edge portion of the openings 104 as illustrated in FIG. 15. The shelf member 106 includes a plurality of outwardly extending flanges 108 which cooperate with and extend through a plurality of correspondingly positioned elongated openings 110 located adjacent the bottom edge portion of each opening 104 as illustrated. The location of the elongated openings 110 below the bottom edge portion of the respective openings 104 may be varied depending upon the particular application involved. Also, the shelf member 106 may include more than one flange portion 108 associated with each respective side portion thereof depending upon the overall size and shape of the resulting container configuration formed by the panel member 100 or a plurality thereof. The present embodiment 99 can be utilized as an attractive point-of-purchase display unit and provides for easy visibility and access to the products positioned on shelf member 106 both through the openings 104 and through the open top portion of the assembly. Depending upon the overall height of the container assembly 99, it is also recognized that any plurality of vertically spaced shelf members 106 and any number of vertically arranged corresponding removable panel sections 102 may be incorporated into panel member 100.

FIG. 16 discloses embodiment 112 of a container assembly which is formed from resilient panel member 114, the panel member 114 being substantially identical to panel member 100 (FIG. 15) except that, unlike panel sections 102, the panel sections 116 are not removable from panel member 114. Instead, the panel sections 116 are scored or otherwise weakened along the periphery of three sides thereof such that each panel section 116 may be folded inwardly along its bottom edge portion as illustrated in FIG. 16. In this particular embodiment, the panel sections 116 form the supporting surface for positioning products thereon thereby obviating the need for using a separate shelf member such as the shelf member 106 illustrated in FIG. 15. The panel sections 116 may be overlapped as shown and some or all of the sections 116 may include cooperatively engagable means for holding and maintaining such panel sections in a joined condition when in their folded positions. This is particularly true of the two opposed panel sections 116. Such cooperatively engageable means may include conventional fastener arrangements as well as VELCRO fastener means. Obviously, due to the construction of the shelf floor formed by panel sections 116, this particular embodiment is designed for use in displaying relatively lightweight products. Where it is desirable to display heavier products within assembly 112, additional support means positioned underneath the shelf floor formed by the folded panel sections 116 may be necessary to provide adequate support for such products. Importantly, the panel members 100 and 114 can be appropriately decorated with indicia to advertise and promote the sale of the particular goods displayed therein.

Since the present body panels 12, 64, 78, 100 and 114 are all made of a lightweight, resilient type material, they can be easily assembled and disassembled as explained above for use both as a multipurpose container assembly and as display signage. Also, importantly, all of the various components comprising the various embodiments of the present container assembly, namely, members 12, 38, 42, 64, 78, 82, 90, 100, 106 and 114 can be packaged, stored and furnished in a compact, substantially flat form. This greatly facilitates transportation and their easy break-down capability enhances portability from one location to another.

It is also recognized that various acceptable materials of construction are available and could equally be employed to fabricate the various components of the present invention. For example, the panel members 12, 64, 78, 100 and 114 could be made from any resilient type material as previously explained such as certain resilient plastic materials, certain rubber-like materials, paperboard, certain metals and metal alloys as well as certain types of treated fabric materials so long as such materials are resilient or flexible enough to allow for sufficient bending of the panel members to achieve a cylindrical or other multi-sided form and such materials are of sufficient rigidity to stand on end to form a container assembly. It is also recognized that a wide variety of cooperatively engageable joinder means other than the tab and notch arrangement 26 and 28 illustrated in the accompanying drawings may be utilized to suitably fasten and attach the opposed side end portions of the various panel members into their closed wall form.

It is also important to note that the overall dimensions of the present container assemblies as well as the particular location and configuration of the various constructional features associated therewith such as tab means 40 and 56, the openings and slots 46, 48, 60 and 80, weakening means 66, handle means 70, string holder means 72, and panel sections 102 and 116 are subject to wide variations; each may be sized and shaped into a wide variety of different sizes and configurations; and each may be incorporated into any of the present panel members in any combination thereof without impairing the teachings and practices of the present invention. The durability, flexibility and versatility of the present multipurpose container and display sign assembly greatly increases its usefulness and effectiveness in a wide variety of applications both indoors and outdoors.

Thus, there has been shown and described several embodiments of a novel multipurpose container and display sign device adaptable for use both indoors and outdoors, which multipurpose devices fulfill all of the objects and advantages sought therefor. Many changes, modifications, variations and other uses and applications of the present constructions will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. A multipurpose panel structure formed of a relatively thin resilient type material for use both as a container device for holding and collecting waste material and as a display sign for communicating a message to people viewing the structure comprising: a one-piece bendable wall member having top, bottom and opposed side edge portions and opposed planar surfaces, said opposed side edge portions including cooperatively engageable interlocking means enabling said wall member to be formed into an open-ended closed wall structure capable of standing on one end to form said container device, said cooperatively engageable interlocking means including a plurality of openings associated with one side edge portion of said wall member and a plurality of sidewardly extending tab members associated with the other side edge portion of said wall member, said plurality of openings and tab members being integrally formed with said wall member, each of said openings including an elongated portion which corresponds in length to the overall length of each of said tab members, each respective tab member including a pair of opposed bendable tab end portions insertable though the elongated portion of each of said openings, each of said pair of bendable tab end portions being positionable in abutting relationship against one planar surface of said wall member on opposite sides of a respective opening through which they are inserted, each of said pair of bendable tab end portions being movable into engagement with an edge portion of the opening through which they are inserted when the opposed side edge portions of said wall member are pulled sidewardly in a first direction which would otherwise open up the closed wall structure formed by said wall member, engagement of said bendable tab end portions with said openings forming self-locking means wherein said closed wall structure is prevented from becoming disengaged during use as said container device, the resiliency of said wall member creating a biasing force which tends to hold the bendable tab end portions in engagement with each said edge portion of each of said openings, said bendable tab end portions being movable out of a self-locking engagement position with said openings when the opposed side edge portions of said wall member are pushed sidewardly in a direction opposite to said first direction, said bendable tab end portions being thereafter releasably detachable from said openings by again insertably positioning said tab end portions through the elongated portions of said openings so as to allow said wall member to return to a relatively flat configuration for storage and transportation from one location to another, a liner member positionable within said open-ended closed wall structure, and at least one liner tab spacedly located adjacent the top edge portion of said wall member for holding said liner member in proper position within said open-ended closed wall structure, said at least one liner tab having an edge portion extending downwardly towards the bottom edge portion of said wall member, said downwardly extending liner tab edge portion being engageable with the liner member when said liner member is overlapped over the top edge portion of said wall member so as to prevent the liner member from becoming disengaged therefrom when said waste material is collected therewithin, said wall member further including means positionable adjacent the top edge portion thereof for hanging said wall member in a flat configuration from a supporting structure.

2. The multipurpose panel structure defined in claim 1 including a floor member positionable within the open-ended closed wall structure, said floor member having means for engaging associated therewith which are cooperatively engageable with means on said wall member for holding said floor member in spaced apart relationship above the bottom end portion of said open-ended closed wall structure.

3. The multipurpose panel structure defined in claim 1 wherein said wall member includes means for anchoring the same to the ground in an outdoor environment, said anchoring means including a plurality of elongated slots positioned in spaced apart relationship adjacent the bottom edge portion of said wall member, said elongated slots being sized and dimensioned so as to receive one end portion of a staking member when inserted therethrough, the one end portion of said staking member bearing against an edge portion of said elongated slots when said staking member is driven into the ground.

4. The multipurpose panel structure defined in claim 1 wherein said open-ended closed wall structure is cylindrical in shape.

5. The multipurpose panel structure defined in claim 1 wherein said relatively thin resilient type material is of a plastic composition.

6. The multipurpose panel structure defined in claim 1 wherein said wall member includes indicia on at least one surface thereof.

7. The multipurpose panel structure defined in claim 1 including a top hinged member hingedly positioned adjacent the top edge portion of said open-ended closed wall structure, said hinged member being movable between a closed position restricting access to said closed wall structure and an open position providing access thereto.

8. The multipurpose panel structure defined in claim 2 wherein said means for engaging on said floor member includes a plurality of circumferentially spaced outwardly extending flanges on said floor member which cooperate with and extend through means for holding on said wall member which includes a plurality of correspondingly positioned openings located on said wall member.

* * * * *